US009962061B2

(12) United States Patent
Firchau et al.

(10) Patent No.: US 9,962,061 B2
(45) Date of Patent: May 8, 2018

(54) DISHWASHER AND METHOD FOR OPERATING A DISHWASHER

(71) Applicants: Dennis Firchau, Baden-Baden (DE); Matthias Oertel, Kehl (DE); Daniel Glasow, Offenburg (DE)

(72) Inventors: Dennis Firchau, Baden-Baden (DE); Matthias Oertel, Kehl (DE); Daniel Glasow, Offenburg (DE)

(73) Assignee: PREMARK FEG L.L.C., Glenview, IL (US)

( * ) Notice: Subject to any disclaimer, the term of this patent is extended or adjusted under 35 U.S.C. 154(b) by 398 days.

(21) Appl. No.: 14/416,651

(22) PCT Filed: Jul. 23, 2013

(86) PCT No.: PCT/US2013/051567
§ 371 (c)(1),
(2) Date: Jan. 23, 2015

(87) PCT Pub. No.: WO2014/018476
PCT Pub. Date: Jan. 30, 2014

(65) Prior Publication Data

US 2015/0173587 A1 Jun. 25, 2015

(30) Foreign Application Priority Data

Jul. 27, 2012 (DE) ..... 10 2012 213 271

(51) Int. Cl.
*A47L 15/42* (2006.01)
*A47L 15/00* (2006.01)
(Continued)

(52) U.S. Cl.
CPC ..... *A47L 15/4293* (2013.01); *A47L 15/0047* (2013.01); *A47L 15/46* (2013.01);
(Continued)

(58) Field of Classification Search
CPC .. A47L 15/0047; A47L 15/46; A47L 15/4293; A47L 15/0026; A47L 15/0028;
(Continued)

(56) References Cited

U.S. PATENT DOCUMENTS

2008/0115807 A1 5/2008 Gaus
2008/0190453 A1 8/2008 Hildenbrand
(Continued)

FOREIGN PATENT DOCUMENTS

DE 102007005834 A1 8/2008
EP 2241240 A1 10/2010
WO 2006/097294 A1 9/2006

OTHER PUBLICATIONS

WIPO machine translation of WO2006097294, Retrieved from https://patentscope.wipo.int/search/en/detail.jsf?docId=WO2006097294&recNum=1&maxRec=&office=&prevFilter=&sortOption=&queryString=&tab=PCTDescription and https://patentscope.wipo.int/search/en/detail.jsf?docId=WO2006097294&recNum=1&tab=PCTClaims&maxRec=&office=&prevFilter=&sortOption=queryString= on Jun. 4, 2017 (Year: 2017).*
(Continued)

*Primary Examiner* — Eric W Golightly
(74) *Attorney, Agent, or Firm* — Thompson Hine LLP

(57) ABSTRACT

A dishwasher (2.1, 2.2) has at least one wash system for spraying wash liquid and at least one final-rinse system for spraying final-rinse liquid, wherein a control device (50) is provided for actuating the at least one wash system and/or the at least one final-rinse system in accordance with a predefined execution program. To save on resources during operation, and meet the requirements for hygienic operation, which are defined in hygiene guidelines applicable locally (in a territorially delimited manner) at least a first execution program is stored in the control device (50), the execution
(Continued)

program created taking into account requirements for hygienic operation which are applicable in a first territorial region, and at least a second execution program is stored in the control device (50), the second execution program created taking into account requirements for hygienic operation which are applicable in a second territorial region.

11 Claims, 2 Drawing Sheets

(51) Int. Cl.
*A47L 15/46* (2006.01)
*A47L 15/24* (2006.01)

(52) U.S. Cl.
CPC ..... *A47L 15/0026* (2013.01); *A47L 15/0028* (2013.01); *A47L 15/247* (2013.01); *A47L 2301/08* (2013.01); *A47L 2501/01* (2013.01); *A47L 2501/04* (2013.01); *A47L 2501/06* (2013.01); *A47L 2501/30* (2013.01)

(58) Field of Classification Search
CPC ..... A47L 15/247; A47L 2501/01; A47L 2501/04; A47L 2501/06; A47L 2501/30; A47L 2301/08
USPC ..... 134/56 D, 18
See application file for complete search history.

(56) References Cited

U.S. PATENT DOCUMENTS

2010/0263687 A1 10/2010 Braun et al.
2010/0287709 A1 11/2010 Doyle et al.

OTHER PUBLICATIONS

PCT, International Search Report and Written Opinion, PCT/US2013/051567 (dated Aug. 4, 2014).

* cited by examiner

DISHWASHER AND METHOD FOR OPERATING A DISHWASHER

TECHNICAL FIELD

The invention relates to a dishwasher with a control device storing multiple execution programs.

Accordingly, the invention relates to a dishwasher, in particular commercial dishwasher or utensil washer, which is in the form of a conveyor dishwasher or in the form of a batch dishwasher and has at least one wash system for spraying wash liquid in a wash zone or during a wash phase and has at least one final-rinse system for spraying final-rinse liquid in a final-rinse zone or during a final-rinse phase, wherein a control device is also provided for actuating the at least one wash system and/or the at least one final-rinse system in accordance with a selected and predefined execution program.

The invention also relates to a method for operating a dishwasher of this kind.

BACKGROUND

Batch dishwashers are dishwashers which can be manually loaded and unloaded. Batch dishwashers (also called "box-type warewashers") may be hood-type dishwashers ("hood-type warewashers") or front-loader dishwashers ("front-loader warewashers"). Front-loader dishwashers may be under-counter machines, top-counter machines or free-standing front-loader dishwashers.

A dishwasher which is in the form of a batch dishwasher usually has a treatment chamber for cleaning washware. The treatment chamber generally has arranged beneath it a wash tank in which liquid from the treatment chamber can flow back due to the force of gravity. The wash tank contains wash liquid which is usually water to which detergent may be added if required.

A dishwasher which is in the form of a batch dishwasher also has a wash system with a wash pump, a line system which is connected to the wash pump, and with a large number of spray nozzles which are formed in the at least one wash arm. The wash liquid contained in the wash tank can be conveyed from the wash pump to the spray nozzles via the line system and be sprayed onto the washware to be cleaned through the spray nozzles in the treatment chamber. The sprayed wash liquid then flows back into the wash tank.

Conveyor dishwashers ("conveyor warewashers") are, in particular, flight-type dishwashers ("flight-type warewashers") or rack-conveyor dishwashers ("rack-conveyor warewashers"). Conveyor dishwashers are usually used in the commercial field. In contrast to batch dishwashers, in which the washware to be cleaned remains stationary in the machine during the cleaning process, the washware is transported through various treatment zones of the conveyor dishwasher in the case of conveyor dishwashers.

A conveyor dishwasher usually has at least one prewash zone and at least one main-wash zone which is arranged downstream of the prewash zone or zones as seen in the transportation direction of the washware. As seen in the transportation direction, at least one postwash zone and at least one final-rinse zone, which is downstream of the postwash zone, are generally arranged downstream of the main-wash zone or zones. As seen in the transportation direction, the washware, which is either accommodated directly on a conveyor belt or is retained by racks, usually runs, in the transportation direction, through an inlet tunnel, the following prewash zone or zones, main-wash zone or zones, postwash zone or zones, final-rinse zone or zones and a drying zone, into an outlet section.

The abovementioned wash zones of the conveyor dishwasher each have an associated wash system which has a wash pump and a line system which is connected to the wash pump, via which wash liquid is supplied to the spray nozzles of the wash zone. The wash liquid which is supplied to the spray nozzles is sprayed onto the washware, which is transported through the respective wash zones by a transportation apparatus of the conveyor dishwasher, in the respective wash zone. Each wash zone has an associated wash tank in which sprayed liquid is accommodated and/or in which wash liquid for the spray nozzles of the relevant zones is provided.

In the case of the conveyor dishwashers which are usually known from the prior art, final-rinse liquid in the form of fresh water, which may be pure or mixed with further additives, for example rinse aid, is sprayed onto the washware via the spray nozzles of the final-rinse zone. At least some of the final-rinse liquid sprayed is transported from zone to zone, counter to the transportation direction of the washware, via a cascade system.

The sprayed final-rinse liquid is collected in a tank (postwash tank) of the postwash zone, from which it is conveyed to the spray nozzles (postwash nozzles) of the postwash zone via the wash pump of the wash system which is part of the postwash zone. In the postwash zone, wash liquid is rinsed off from the washware. The liquid which accumulates in the process flows into the wash tank of the at least one main-wash zone which is arranged upstream of the postwash zone as seen in the transportation direction of the washware. Here, the liquid is usually provided with a detergent and is sprayed onto the washware by a pump system (wash pump), which is part of the wash system of the main-wash zone, via the nozzles (wash nozzles) of the main-wash zone. If no further main-wash zones are provided, the liquid then flows from the wash tank of the main-wash zone into the prewash tank of the prewash zone. The liquid in the prewash tank is sprayed onto the washware via a pump system, which is part of the wash system of the prewash zone, via the prewash nozzle of the prewash zone in order to remove coarse dirt from the washware.

Irrespective of whether the dishwasher is in the form of a batch dishwasher or in the form of a conveyor dishwasher, the dishwashers under consideration here and, in particular, designed for commercial use therefore usually comprise a wash system which has a wash pump which ensures a virtually constant water circulation rate for the duration of a wash process in the treatment chamber (in the case of batch dishwashers) or in the respective treatment zone (in the case of conveyor dishwashers). The respective wash pumps of the wash systems are switched on and switched off by a control device (machine controller) which is part of the dishwasher in accordance with a selected and predefined execution program. The control device is also used to set further process parameters of the wash process, which process parameters are defined in the selected execution program, by actuating suitable components of the dishwasher. Said process parameters include, for example, the temperature of the wash liquid sprayed during the wash process, the nozzle pressure with which the wash liquid is sprayed onto the washware during the wash process, possibly the quantity of wash liquid sprayed during the wash process per unit time, and the washware contact time, that is to say the period of time over which the washware is subjected to the action of wash liquid.

In addition, at least one final-rinse system is provided in the dishwashers under consideration here in order to spray final-rinse liquid in the treatment chamber during a final-rinse phase in the case of batch dishwashers or in a final-rinse zone in the case of conveyor dishwashers. The process parameters which are to be complied with during the final-rinse process are likewise defined in a selected and predefined execution program and are set during the final-rinse process using the control device by suitable actuation of corresponding actuable components of the dishwasher. These process parameters include, for example, the temperature of the final-rinse liquid sprayed during the final-rinse process, the nozzle pressure with which the final-rinse liquid is sprayed onto the washware during the final-rinse process, possibly the quantity of final-rinse liquid sprayed during the final-rinse process per unit time and the washware contact time, that is to say the period of time over which the washware is subjected to the action of final-rinse liquid.

In contrast to conveyor dishwashers, the two main process steps "wash phase" and "final-rinse phase" are performed laterally in succession, but not physically separately, in one zone (treatment chamber) in the case of batch dishwashers.

To this end, a dishwasher which is in the form of a batch dishwasher is normally equipped with two liquid systems which are independent of one another and which are completely separate from one another. One of these two liquid systems is a wash liquid circuit in which—for the purpose of cleaning the washware—the wash liquid from the above-mentioned wash tank beneath the treatment chamber is recirculated. The other liquid system is a final-rinse liquid system which can usually have a water heater ("boiler") for heating fresh water which is used as final-rinse liquid.

Irrespective of whether the dishwasher is designed in the form of a batch dishwasher or in the form of a conveyor dishwasher, the main task of final rinsing using final-rinse liquid is that of removing the wash liquid (detergent solution) remaining on the washware after the wash phase. Accordingly, the final-rinse liquid used is preferably fresh water to which a rinse aid may be added in a metered fashion.

In the case of batch dishwashers, the final-rinse liquid which flows away, during final rinsing, into the tank which is arranged beneath the treatment chamber is additionally used to regenerate the wash liquid accommodated in the tank since the final-rinse liquid (pure fresh water or fresh water which is mixed with rinse aid) which is sprayed in the treatment chamber during the final-rinse phase flows into the tank which is arranged beneath the treatment chamber due to the force of gravity. Before new final-rinse liquid enters the tank in this way during the final-rinse phase in order to regenerate the wash liquid, the same quantity of wash liquid is pumped out of the tank in the case of batch dishwashers.

In principle, washware has to be treated in a washer, in particular dishwasher, in such a way that the washware is in a hygienically satisfactory state after treatment. This means, in particular, that, after treatment, the surfaces of all the items of washware have to be in a state which prevents adverse health effects when the items of washware are subsequently used. This applies for hospitals and homes for people who are physically compromised, but also for mass catering in canteens, refectories and service areas as well as eating and drinking establishments.

In this connection, a working group with effect for the jurisdiction of the Federal Republic of Germany has been formed for addressing hygiene issues from which the standards DIN 10510 and DIN 10512, amongst others, have been developed. These standards are hygiene guidelines which have to be complied with when commercial dishwashers are used, for example in canteens, refectories and service areas and also eating and drinking establishments, in the territorial region of the Federal Republic of Germany. Said hygiene guidelines (DIN 10510 and 10512) specify, in particular, the hygiene requirements for planning and construction and also the operation of commercial dishwashers in order to define the requirements for hygienic operation of a commercial dishwasher applicable in the territory of the Federal Republic of Germany.

In order to be able to comply with the requirements for hygienic operation of a commercial dishwasher defined in the hygiene guidelines applicable in the Federal Republic of Germany, the spray mechanics, that is to say the way in which the detergent solution (wash liquid and final-rinse liquid) acts on the washware, the required minimum temperatures of the wash liquid and final-rinse liquid and the minimum contact time, for example, are defined in this connection (cf. for example chapter 5.4 "Process requirements" of the standard DIN 10510 applicable on the date of application). For example, the hygiene guideline (standard DIN 10510) which is applicable to conveyor dishwashers prescribes that there must be a minimum temperature of 55° C. in the main-wash zone of the dishwasher in the associated wash tank if there is a sufficient quantity of a disinfection component in the wash liquid. Otherwise, the temperature of the wash liquid has to be at least 60° C. In respect of the final-rinse liquid which is to be sprayed in the final-rinse zone of the conveyor dishwasher, the hygiene guideline specifies a minimum temperature of 80° C.

Under certain circumstances, other requirements for the hygienic operation of a commercial dishwasher may apply in the territory outside the Federal Republic of Germany since there are currently no globally applicable hygiene guidelines. In this connection, reference may be made, for example, to the standard NSF/ANSI3 which is applicable in the jurisdiction of the United States of America. In respect of the hygienic operation of a conveyor dishwasher, this guideline specifies, for example, that there has to be a minimum temperature of 66° C. in the main-wash zone of the dishwasher in the associated wash tank, wherein the final-rinse liquid which is to be sprayed in the final-rinse zone of the conveyor dishwasher has to have a minimum temperature of 82° C. In respect of the hygienically satisfactory operation of batch dishwashers, the version of standard NSF/ANSI3 applicable on the date of application specifies that the liquid (wash liquid or final-rinse liquid) sprayed during the wash phase and during the final-rinse phase each have to have a minimum temperature of 74° C.

Further territorially applicable hygiene guidelines, in which the process parameters which are to be complied with during operation of dishwashers are defined, also exist in addition to the abovementioned hygiene guidelines which are applicable in the Federal Republic of Germany and the United States of America. In this connection, it should be noted that there are currently no uniformly applicable hygiene guidelines. In other words, the process parameters which are each specified in the various territorially applicable hygiene guidelines for ensuring hygienically satisfactory operation of dishwashers sometimes differ considerably.

In order for machine manufacturers to be able to offer and sell their range of products on the worldwide market irrespective of the different territorially applicable requirements for hygienic operation, it is currently customary to design the dishwasher or to program the execution program stored in the control device of the dishwasher such that, in principle, the most stringent requirements for the specified process parameters from amongst all of the hygiene guidelines which are to be taken into consideration are met. This ensures that the requirements for hygienic operation which are specified in all territorially applicable hygiene guidelines are met during operation of the dishwasher.

In other words: in order for a dishwasher, in particular commercial dishwasher, to be able to be used irrespective of the region of use, execution programs are usually stored in the control device of the dishwasher, said execution programs having been created taking into account the strictest worldwide standards in respect of hygienic operation. This ensures that, in principle, the respectively applicable local hygiene guidelines are met during operation of the dishwasher.

SUMMARY

The present invention is based on the problem that the individual local hygiene guidelines in respect of the minimum process parameters defined in said guidelines sometimes differ considerably, in particular in respect of the minimum temperature of the wash liquid, minimum temperature of the final-rinse liquid or the quantity of final-rinse liquid sprayed in the final-rinse zone or during the final-rinse phase per unit time.

In particular, the present invention has tackled the as yet unidentified problem that currently the control device of a dishwasher is programmed at the site of manufacture such that in principle all existing locally applicable hygiene guidelines are met, with the result that the washware is excessively treated in those territorial regions in which less stringent hygiene guidelines apply, and this undeniably results in an increase in consumption of resources (energy, fresh water and chemicals).

On the basis of this as yet unidentified problem, the invention is therefore based on the object of developing a dishwasher of the kind cited in the introductory part to the effect that resources can be saved during operation of the dishwasher in a manner which is simple to realize yet is effective, wherein the requirements for the hygienic operation of the dishwasher specified in the respectively locally (territorially limited) applicable hygiene guidelines are met.

Advantageous developments of the dishwasher according to the invention are specified in the respective dependent claims.

In respect of the dishwasher, provision is therefore made, according to the invention, for at least a first execution program and also at least one further second execution program to be stored in the control device. The first execution program has been created taking into account requirements for hygienic operation of a commercial dishwasher which are applicable in a first territorial region, wherein the second execution program has been created taking into account requirements for hygienic operation of a commercial dishwasher which are applicable in another, second territorial region.

The expression "created taking into account requirements for hygienic operation of a commercial dishwasher which are applicable in territorial region" used in the present application is to be understood as an execution program which defines the process parameters (in particular temperature of the wash and/or final-rinse liquid, contact time, quantity of liquid sprayed per unit time etc.) which vary during washing of washware and can be set with the aid of the control device, such that the requirements for hygienic operation of the dishwasher which are applicable in one territorial region during operation of the dishwasher are met such that the hygiene guidelines which are applicable in this territorial region can be complied with.

Since, according to the invention, at least two different execution programs are stored in the controller, a specific execution program can be selected by the user of the dishwasher in order to meet the correspondingly applicable local hygiene guidelines.

The solution according to the invention is particularly suitable for dishwashers which are used in the maritime sector. For example, it is entirely usual, for example, for cruise ships to cross different continents over relatively short intervals of time. The dishwashers provided in the kitchens of such cruise ships therefore have to be designed to meet selectively different local hygiene guidelines. In order to meet all the standards in respect of the hygienic operation in commercial dishwashing applicable for the potential region of use of the ship, the program parameters applicable for the strictest standards were, in the past, selected and stored in the dishwasher controller. As a result, all other standards were also met.

In accordance with the solution according to the invention, various temperature profiles and settings for the quantity of final-rinse liquid or wash liquid and other operating parameters are stored in the control device, these reflecting the respective standards under discussion. The operator can therefore in each case select the execution program which is required for the region in which the ship is traveling, wherein the dishwasher as a result, in principle, consumes only the quantity of resources (energy, fresh water, chemicals) required for meeting the respective hygiene guideline or standard.

In accordance with a preferred embodiment of the solution according to the invention, the at least one first and the at least one second execution program define a minimum value for the temperature of the wash liquid which is sprayed in the wash zone or during the wash phase and/or a minimum value for the temperature of the final-rinse liquid which is sprayed in the final-rinse zone or during the final-rinse phase, wherein the at least one first and second execution program differ in respect of the minimum temperature values which are defined for the wash liquid and/or final-rinse liquid.

As an alternative or in addition to this, it is feasible for the at least one first and the at least one second execution program to define a minimum value for a quantity of wash liquid which is sprayed in the wash zone or during the wash phase per unit time and/or a minimum value for a quantity of final-rinse liquid which is sprayed in the final-rinse zone or during the final-rinse phase per unit time, wherein the at least one first and second execution program differ in respect of the defined minimum quantities of wash liquid or final-rinse liquid which are to be sprayed per unit time.

Furthermore, as an alternative or in addition to this, it is feasible for the at least one first and the at least one second execution program to define a minimum value for a duration of the wash phase and/or a minimum value for the duration of the final-rinse phase, wherein the at least one first and the at least one second execution program differ in respect of the minimum value for the duration which is defined for the wash phase and/or final-rinse phase.

On the other hand, it is feasible for the at least one first and the at least one second execution program to define a minimum value for a washware contact time in the wash zone or during the wash phase and/or a minimum value for the washware contact time in the final-rinse zone or during the final-rinse phase, wherein the at least one first and second execution programs differ in respect of the minimum contact times which are defined for the wash and/or final-rinse zone or the wash and/or final-rinse phase.

In respect of the parameters which are stored in the control device, it is further feasible for the at least one first and the at least one second execution program to define a minimum value for an application pressure (spray mechanics) of the wash liquid which is sprayed in the wash zone or during the wash phase and a minimum value for an application pressure of the final-rinse liquid which is sprayed in the final-rinse zone or during the final-rinse phase, wherein the at least one first and second execution program differ in respect of the minimum application pressure which is defined for the wash and/or final-rinse liquid.

In a preferred development of the dishwasher according to the invention, provision is made for said dishwasher to have a user interface by means of which the user can preferably manually select an execution program which is stored in the control device. As already cited, the execution program is selected and defined, in particular, in respect of the currently applicable local standards or hygiene guidelines.

In this connection, it is particularly advantageous when the respective execution programs are stored in a memory device of the control device, wherein the user interface also has a programming interface for overwriting and/or updating the execution programs which are already stored in the memory device of the control device as required. This is necessary particularly when a locally applicable hygiene guideline is changed or revised.

According to one aspect of the present invention, the dishwasher is in the form of a conveyor dishwasher, in particular a belt-conveyor dishwasher or rack-conveyor dishwasher, and has a conveyor apparatus for conveying the washware which is to be cleaned through the treatment zones of the dishwasher. The wash system of the dishwasher is implemented in at least one wash zone in which wash liquid is sprayed out of a wash tank, which is associated with the at least one wash zone, with the aid of a wash pump by means of wash nozzles, onto the washware which is to be cleaned. The final-rinse system is implemented in at least one final-rinse zone which is downstream of the wash zone—as seen in the conveying direction of the washware—and in which final-rinse liquid is sprayed out of a final-rinse reservoir, which is associated with the at least one final-rinse zone, with the aid of a final-rinse pump by means of final-rinse nozzles, onto the washware which is to be cleaned.

In this connection, it is particularly advantageous when the wash tank, which is associated with the at least one wash zone, has a heating device which can be actuated by the control device in such a way that the temperature of the wash liquid in the wash tank assumes a temperature value, in particular a minimum temperature value, which is defined in a selected and predefined execution program for the wash phase. As an alternative or in addition to this, it is advantageous when the final-rinse reservoir which is associated with the at least one final-rinse zone has a final-rinse tank with a heating device which can be actuated by the control device in such a way that the temperature of the final-rinse liquid in the final-rinse reservoir assumes a temperature value, in particular a minimum temperature value, which is defined in a selected and predefined execution program for the final-rinse phase.

It is also advantageous when the wash pump can be actuated by the control device such that the nozzle pressure of the wash nozzles assumes a value which corresponds to an application pressure, in particular a minimum application pressure, which is defined in a selected execution program for the wash phase.

A residence time of washware, which is conveyed through the dishwasher with the aid of the conveyor apparatus, in the at least one wash zone and in the at least one final-rinse zone is defined by suitable actuation of the conveyor apparatus by means of the control device in such a way that a washware contact time, in particular a minimum contact time, which is defined in a selected execution program for the wash phase and final-rinse phase, is complied with.

In respect of the dishwasher which is designed as a conveyor dishwasher, it is also advantageous when the final-rinse pump can be actuated by the control device in such a way that the quantity of final-rinse liquid which is sprayed in total in the final-rinse zone per unit time corresponds to a value, in particular a minimum value, which is defined in a selected execution program.

In accordance with a further aspect of the present invention, the dishwasher is in the form of a batch dishwasher, in particular designed as an under-counter dishwasher, top-counter dishwasher or hood-type dishwasher, and has a treatment chamber in which washware can be held. In this case, the wash system of the dishwasher has a wash pump by means of which wash liquid can be sprayed from a wash tank, which is arranged beneath the treatment chamber, by means of a wash line system and by means of wash nozzles, into the treatment chamber of the dishwasher. The final-rinse system of the dishwasher has a final-rinse pump by means of which final-rinse liquid can be sprayed from a final-rinse reservoir, by means of a final-rinse line system and by means of final-rinse nozzles, into the treatment chamber.

The wash tank which is arranged beneath the treatment chamber preferably has a heating device which can be actuated by the control device in such a way that the temperature of the wash liquid in the wash tank assumes a temperature value, in particular a minimum temperature value, which is defined in a selected execution program for the wash phase. As an alternative or in addition to this, provision is made, in the dishwasher according to the invention which is in the form of a batch dishwasher, for the final-rinse reservoir to have a final-rinse tank with a heating device which can be actuated by the control device in such a way that the temperature of the final-rinse liquid in the final-rinse tank assumes a temperature value, in particular a minimum temperature value, which is defined in a selected execution program for the final-rinse phase.

In addition or as an alternative to this, provision is made for the final-rinse pump to be able to be actuated by the control device in such a way that a quantity of final-rinse liquid which is sprayed in the final-rinse zone per unit time corresponds to a value, in particular a minimum value, which is defined in a selected execution program.

In respect of the method according to the invention for operating a dishwasher, provision is made in a first method step for a requirement for the hygienic operation of a commercial dishwasher, in particular a relevant standard, hygiene guideline or the like, which is applicable in a territorial region to first be defined. An execution program for the dishwasher is then selected, wherein this execution program has been created taking into account the defined requirement for the hygienic operation of a commercial dishwasher. The washware is then treated in accordance with the selected execution program.

BRIEF DESCRIPTION OF THE DRAWINGS

Preferred exemplary embodiments of the solution according to the invention will be described below with reference to the appended drawings, in which.

DETAILED DESCRIPTION

Figure 1:
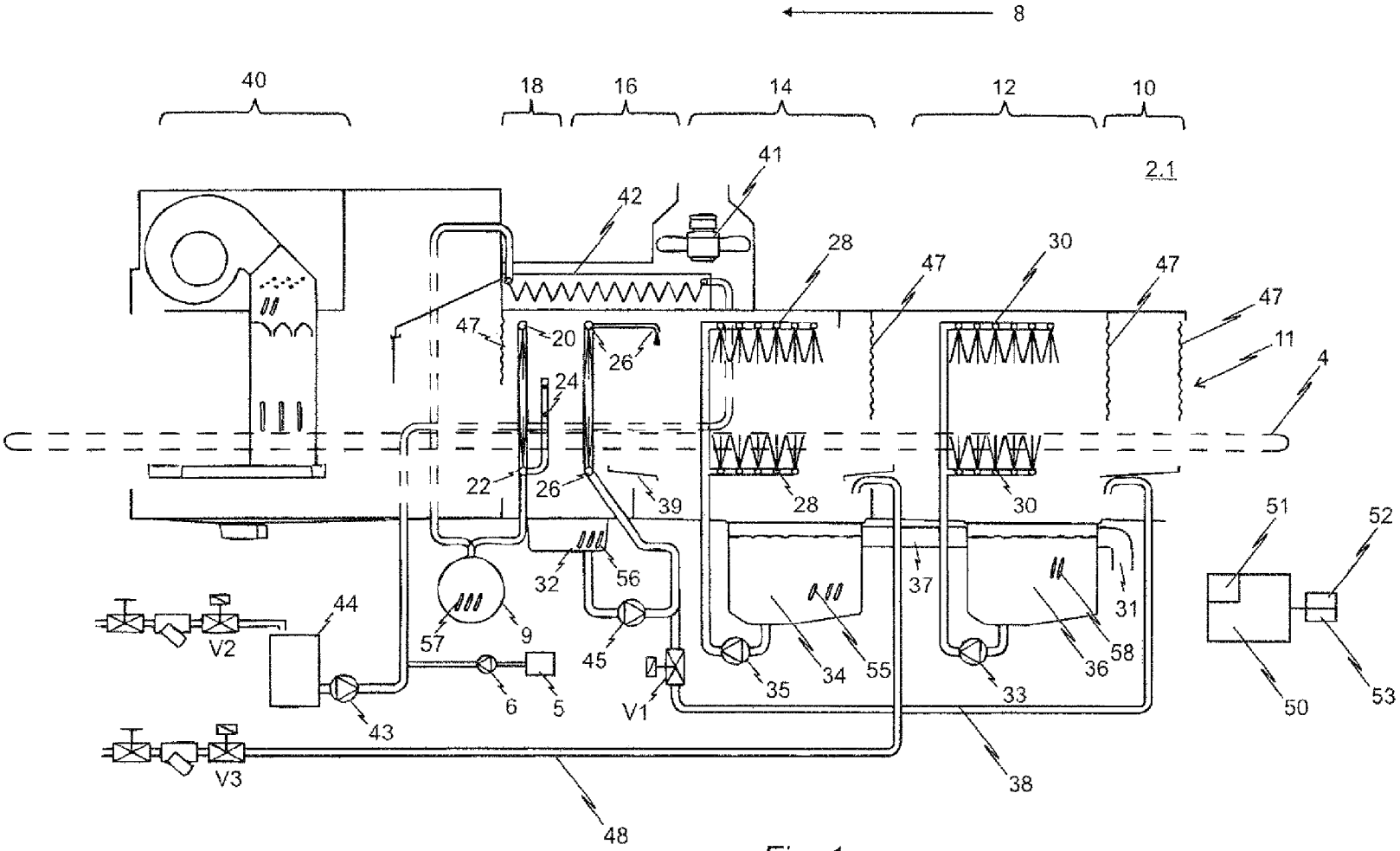
FIG. 1: schematically shows a dishwasher, which is designed in the form of a conveyor dishwasher, according to a first embodiment of the present invention.

FIG. 1 shows a conveyor dishwasher 2.1 having a conveyor apparatus 4 for conveying washware (not illustrated) in a conveying direction 8 through the conveyor dishwasher 2.1.

The conveyor dishwasher 2.1 has at least one wash zone, as illustrated in FIG. 1 for example, a prewash zone 12 and a main-wash zone 14 which is arranged downstream of the prewash zone 12 as seen in the conveying direction 8.

As seen in the conveying direction 8, a postwash zone 16 is arranged downstream of the at least one wash zone 12, 14, and at least one final-rinse zone, for example only a single final-rinse zone 18 as illustrated, is arranged downstream of the postwash zone 16. In the conveyor dishwasher 2.1 illustrated in FIG. 1, the final-rinse zone 18 is followed in the conveying direction 8 of the washware by a drying zone 40. The respective zones 12, 14, 16, 18, 40 of the conveyor dishwasher 2.1 can be separated from one another by means of separating curtains 47. In the embodiment illustrated in FIG. 1, the inlet tunnel 10 itself is also separated from the inlet 11 by a separating curtain 47. The provision of the separating curtains 47 prevents wash liquid and final-rinse liquid spraying between zones and prevents vapors escaping from the conveyor dishwasher 2.1.

Said treatment zones 12, 14, 16, 18 of the conveyor dishwasher 2.1 have associated spray nozzles 20, 22, 24, 26, 28, 30. These spray nozzles 20, 22, 24, 26, 28, 30 serve to spray liquid onto the washware as said washware is conveyed through the respective treatment zones 12, 14, 16, 18 by the conveyor apparatus 4. The individual spray systems of the treatment zones 12, 14, 16, 18 ensure that the washware to be treated is hosed down both from the top and from the bottom.

However, in the conveyor dishwasher 2.1 schematically illustrated in FIG. 1, the final-rinse zone 18 not only has downwardly directed upper spray nozzles 20 and upwardly directed lower spray nozzles 22, but also transversely directed lateral spray nozzles 24 on either side of the conveyor apparatus 4. The use of lateral spray nozzles 24 permits areas of the washware (areas of the dishes) to be sprayed with final-rinse liquid in a targeted manner in shadow zones too. The use of lateral spray nozzles 24 in the final-rinse zone 18 has a significant advantage in terms of the final-rinse result (effective rinsing-off of detergent residues from dish surfaces in shadow zones too) over systems in which only upper and lower spray nozzles 20, 22 and no transversely directed spray nozzles 24 are provided in the final-rinse zone 18, specifically when the conveying system is fully loaded, that is to say with plate-to-plate loading of the dish rack.

The postwash zone 16, main-wash zone 14 and prewash zone 12 also have associated tanks (postwash tank 32, main-wash tank 34, prewash tank 36) for accommodating sprayed liquid and/or for providing liquid for the spray nozzles 26, 28, 30 of the relevant treatment zones 14, 16, 18.

As already indicated, final-rinse liquid, which comprises fresh water with rinse aid which is added in a metered fashion, is sprayed onto the washware (not illustrated) by means of the spray nozzles 20, 22, 24 of the final-rinse zone 18 which are arranged above and below the conveyor apparatus 4 and on the side in the conveyor dishwasher 2.1 illustrated in FIG. 1. A portion of the sprayed final-rinse liquid is conveyed from treatment zone to treatment zone via a cascade system in the opposite direction to the conveying direction 8 of the washware. The remaining portion of the final-rinse liquid sprayed in the final-rinse zone 18 is conducted directly into the prewash tank 36, which is associated with the prewash zone 12, by means of a valve V1 and a bypass line 38.

In the cascade system, the final-rinse liquid sprayed by the final-rinse nozzles 20, 22, 24 flows from the final-rinse zone 18 into the postwash tank 32, which is associated with the postwash zone 16, due to the force of gravity. The final-rinse liquid sprayed in the final-rinse zone 18 and collected by the postwash tank 32 is then delivered to the spray nozzles (postwash nozzles 26) of the postwash zone 16 with the aid of a postwash pump 45.

Wash liquid is rinsed off from the washware in the postwash zone 16. The liquid (postwash liquid) produced in the process flows into the main-wash tank 34, which is associated with the main-wash zone 14, due to the force of gravity. A discharge element 39, for example a discharge base or a baffle plate, which conducts the postwash liquid sprayed by the postwash nozzles 26 into the main-wash tank 34, is preferably provided for this purpose. According to another embodiment (not shown), the outlet element 39 can be dispensed with if the main-wash tank 34 extends as far as beneath the postwash nozzles 26 of the postwash zone 16.

The liquid accommodated by the main-wash tank 34 of the main-wash zone 14 is usually provided with a detergent and sprayed onto the washware by means of the spray nozzles (main-wash nozzles 28) of the main-wash zone 14 with the aid of a main-wash pump 35. The wash liquid sprayed by the main-wash nozzles 28 flows back into the main-wash tank 34 due to the force of gravity.

The main-wash tank 34 is fluidically connected to the prewash tank 36, which is associated with the prewash zone 12, via an overflow line 37. The wash liquid sprayed in the main-wash zone 14 enters the prewash tank 36 via this overflow line 37 when there is a sufficient quantity of wash liquid in the main-wash tank 34.

The liquid accommodated in the prewash tank 36 of the prewash zone 12 is then sprayed onto the washware by means of the spray nozzles (prewash nozzles 30) of the prewash zone 12 with the aid of a prewash pump 33 in order to remove coarse particles of dirt from the washware. The wash liquid sprayed by the prewash nozzles 30 flows back into the prewash tank 36 due to the force of gravity.

The prewash tank 36 is provided with an overflow line 31 which is used to feed the excess quantity of liquid to a wastewater system if a liquid level in the prewash tank 36 is exceeded.

As already indicated, the liquid sprayed in the main-wash zone 14 and in the prewash zone 12 preferably contains detergent which is added in a metered fashion with the aid of a detergent metering apparatus (not shown in the drawings), for example, to the liquid accommodated in the main-wash tank 34 of the main-wash zone 14.

As already mentioned, the final-rinse zone 18 is followed by the drying zone 40 in the conveying direction 8. In the drying zone 40, the washware is dried using dry and heated air in order to blow off and/or dry up the moisture on the washware. In order to keep the moisture content of the air in a range which is expedient for drying, it is feasible, for example, to supply external room air to the drying zone 40 via an opening, for example through the outlet opening for the washware.

The warm and moisture-laden air in the drying zone 40 is then drawn off from the drying zone 40 via a further opening, for example with the aid of a fan 41. It is advantageous here if the exhaust-air stream from the drying zone 40 passes a heat-recovery device 42 in which, for example, a condenser can be provided. The heat-recovery device 42 serves to recover at least some of the thermal energy contained in the exhaust air.

If, before initial starting of the conveyor dishwasher 2.1, the tanks (prewash tank 36, main-wash tank 34, postwash tank 32) associated with the wash zones 12, 14 and 16 are empty or insufficiently filled, said tanks first have to be filled via a fresh-water line 48 and/or by spraying final-rinse liquid in the final-rinse zone 18. The fresh-water line 48 can be connected to a fresh-water supply system via an actuable valve V3. The quantity of wash liquid available in the main-wash zone 14 and in the prewash zone 12 can in each case be monitored and signaled to a control device 50 with the aid of a level sensor provided in the main-wash tank 34 and with the aid of a level sensor provided in the prewash tank 36.

The final-rinse zone 18 can—as illustrated in FIG. 1—have an associated fresh-water container 44 for temporarily storing at least a portion of the fresh water provided for final-rinsing purposes. The fresh-water container 44 is firstly provided with a fresh-water connection which can be connected to a fresh-water supply system via an actuable fresh-water feed valve V2, and secondly is connected to the intake end of a final-rinse pump 43. However, it goes without saying that it is also feasible to dispense with a fresh-water container 44 for temporarily storing at least a portion of the fresh water provided for final-rinsing purposes and to connect the fresh-water feed valve V2 directly to the intake end of the final-rinse pump 43.

The delivery end of the final-rinse pump 43 is connected to a water heater 9 ("boiler") via a line system. In this case, the line system is designed in such a way that the liquid delivered from the final-rinse pump 43 to the spray nozzles 20, 22, 24 of the final-rinse zone 18 first passes the heat-recovery device 42 before reaching the water heater 9. In this way, it is possible to use at least some of the thermal energy from the discharged exhaust air to heat up the liquid supplied to the spray nozzles 20, 22, 24 of the final-rinse zone 18.

Rinse aid is added in a metered fashion with the aid of a rinse-aid metering apparatus 5 to the fresh water which is supplied to the final-rinse pump 43 either directly by the fresh-water feed valve V2 or by the fresh-water container 44. The rinse-aid metering apparatus 5 is particularly preferably arranged in such a way that rinse aid is added in a metered fashion to the fresh water in a position in which the fresh water has not yet been heated. Experiments have shown that the rinse aid and fresh water mix significantly better and more uniformly when the rinse aid is added in a metered fashion to unheated fresh water. Specifically, rinse aid should be added in a metered fashion to fresh water which is at a temperature of less than 40° C., and preferably less than 30° C. For this reason, rinse aid is added in a metered fashion between the final-rinse pump 43 and the water heater 9 or the heat-recovery device 42 in the embodiment of the conveyor dishwasher 2.1 illustrated in FIG. 1. To this end, a feed line which issues between the final-rinse pump 43 and the heat-recovery device 42 and can be connected to the rinse-aid metering apparatus 5 via a rinse-aid pump 6 is provided in the line system.

The abovementioned control device 50 is schematically indicated in the conveyor dishwasher 2.1 illustrated in FIG. 1. Different, predefined or predefinable execution programs are stored in the control device 50. To this end, the control device 50 has a corresponding memory device 51 which, in this case, is preferably a random access memory (RAM).

Each individual execution program defines the process parameters which can be defined for treating the washware in the different treatment zones of the conveyor dishwasher 2.1. Process parameters may include, in particular, the following variables:

- the temperature, in particular minimum temperature, of the wash liquid which is sprayed in the prewash zone 12;
- the temperature, in particular minimum temperature, of the wash liquid which is sprayed in the main-wash zone 14;
- the temperature, in particular minimum temperature, of the liquid which is sprayed in the postwash zone 16;
- the temperature, in particular minimum temperature, of the final-rinse liquid which is sprayed in the final-rinse zone 18;
- the nozzle pressure of the wash liquid which is sprayed in the prewash zone 12, main-wash zone 14 and/or postwash zone 16;
- the nozzle pressure of the final-rinse liquid which is sprayed in the final-rinse zone 18.

To this end, it is preferred when a corresponding heating device 55, 56, 58 is arranged in the prewash tank 36 which is associated with the prewash zone 12, in the main-wash tank 34 which is associated with the main-wash zone 14 and/or in the postwash tank 32 which is associated with the postwash zone 16, in order to control the temperature of the liquid which is collected in the tank 32, 34, 36 in question in accordance with a selected execution program. Said heating devices 55, 56, 58 can be correspondingly controlled by the control device 50.

Furthermore, a heating device 57 of the water heater 9 can be correspondingly controlled by the control device 50 in order to set the temperature, in particular minimum temperature, of the final-rinse liquid which is sprayed in the final-rinse zone 18 in accordance with the process parameters defined in a selected execution program.

In order to be able to vary the nozzle pressure in the different treatment zones, it is preferred when the control device 50 is connected to the corresponding wash pumps 33, 35, 45, wherein said pumps are preferably designed in the form of pumps of which the rotation speed is controlled. The same also applies for the final-rinse pump 43 which can be correspondingly controlled by the control device 50 in order to be able to correspondingly set the nozzle pressure of the final-rinse liquid sprayed in the final-rinse zone 18.

It is further preferred when the conveying speed at which the washware is conveyed through the respective treatment zones 12, 14, 16, 18 in conveying direction 8 can be set with the aid of the control device 50. In this way, the minimum contact time of the washware which is defined in an execution program can be set by suitable actuation of the conveyor apparatus.

The control device 50 is also designed to set the quantity of final-rinse liquid sprayed in the final-rinse zone 18 per unit time and/or in order to set the quantity of wash liquid which is sprayed in the main-wash zone 14 per unit time in accordance with specifications of a corresponding execution program.

In summary, the control device 50 is designed to actuate the different actuable components of the conveyor dishwasher 2.1, for example the respective pumps and valves and heating devices, in accordance with a selected, predefined or predefinable execution program in order to be able to set the process parameters in the individual treatment zones 12, 14, 16, 18 of the conveyor dishwasher 2.1.

Figure 2:
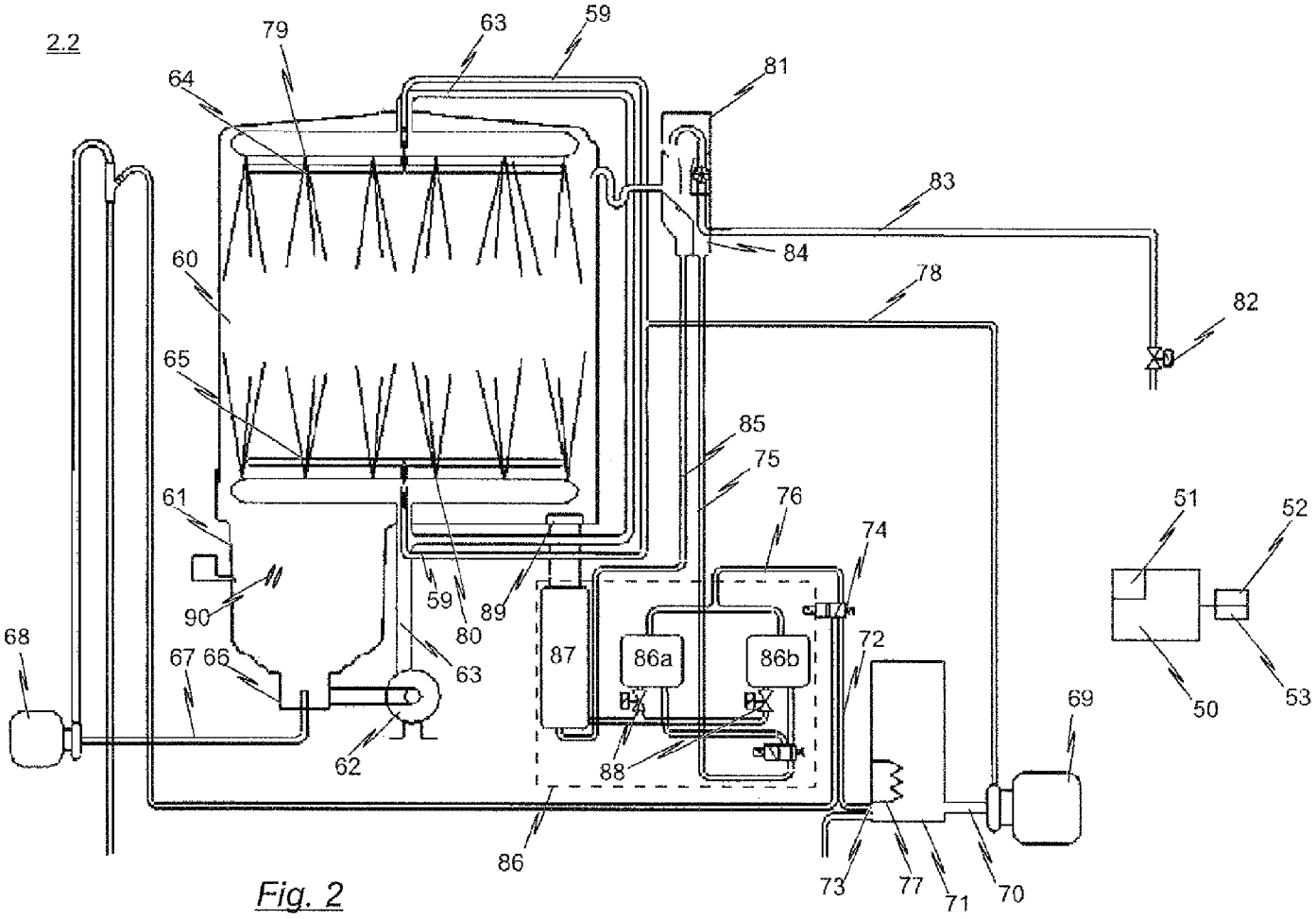
FIG. 2: schematically shows a dishwasher, which is designed in the form of a batch dishwasher, according to a second embodiment of the invention.

The dishwasher 2.2 illustrated in FIG. 2 as an example contains a treatment chamber 60 for cleaning washware (not shown). A tank 61 is arranged beneath the treatment chamber 60, it being possible for liquid to flow from the treatment chamber 60 back into said tank due to the force of gravity. The tank 61 can be covered by a screen (not illustrated in FIG. 2) at the transition to the treatment chamber 60.

The tank 61 contains cleaning liquid, which is usually water, to which a detergent can be either automatically or manually supplied by a detergent metering apparatus (not explicitly illustrated in FIG. 2). The type, that is to say the chemical composition, and the quantity of the detergent which is added in a metered fashion can depend on the type and/or the degree of soiling of the washware which is to be cleaned in the dishwasher 2.2. For example, it is feasible, for cleaning glasses by machine, for a standard detergent which is optimized for this purpose to be used, the chemical composition of said detergent being matched to the material of the washware (glass) and/or to the degree of soiling which is to be expected with this type of washware.

The cleaning liquid can be delivered from a pump 62 to cleaning nozzles 64, 65 by means of a line system 63 and can be sprayed onto the washware which is to be cleaned by these cleaning nozzles 64, 65 in the treatment chamber 60. The sprayed cleaning liquid then flows back into the tank 61. A discharge line 67 with a discharge pump 68 can be connected to the lower end 66 of the tank 61 in order to fully or partially empty the tank 61 as required.

In the embodiment of the dishwasher 2.2 according to the invention illustrated in FIG. 2, a final-rinse pump 69 is connected to an outlet 70 of a water heater (boiler) 71 by way of its intake end. The water heater 71 has an inlet 73 which is connected to a fresh-water feed line 72. The fresh-water feed line 72 can be connected to further fresh-water feed lines 75, 76 by means of a valve 74, so that either fresh water or fresh water to which a rinse aid has been added in a metered fashion can be supplied to the water heater 71. The water heater 71 has a heating means 77, so that the liquid (pure fresh water or fresh water to which rinse aid has been added in a metered fashion) which is supplied via the inlet 73 can be heated according to the prespecification of a process sequence. The final-rinse liquid which is selectively heated in the water heater 71 or is not heated can be routed to final-rinse nozzles 79 and 80 via a final-rinse line system 78 for example during a final-rinse phase by means of the final-rinse pump 69 which is connected to the outlet 70 of the water heater 71 by way of its intake end. The final-rinse nozzles 79 and 80 are arranged in the treatment chamber 60 in order to spray the final-rinse liquid, which is heated in the water heater 71, in the treatment chamber 60 onto the washware. However, it goes without saying that it is also feasible for pure fresh water to be supplied to the water heater 71 via the inlet 73 and the fresh-water feed line 72, a rinse aid being added in a metered fashion to said pure fresh water only after it is heated in the water heater 71.

The solution according to the invention is not restricted to the presence of a water heater 71. Instead, the provision of a water heater 71 can also be dispensed with within the scope of the invention, so that unheated final-rinse liquid is delivered to the final-rinse nozzles 79 and 80 which are arranged in the treatment chamber 60 and is sprayed onto the washware.

In the embodiment of the dishwasher 2.2 according to the invention schematically illustrated in FIG. 2, the cleaning nozzles 64 and 65 and the final-rinse nozzles 79 and 80 are respectively in each case preferably arranged above and below the washware region and are directed toward the washware region of the treatment chamber 60. Specifically, in the illustrated embodiment, a downwardly directed upper cleaning nozzle system and a similarly downwardly directed upper final-rinse nozzle system which is designed separately from said upper cleaning nozzle system and also an upwardly directed lower cleaning nozzle system and a similarly upwardly directed lower final-rinse nozzle system which is designed separately from said lower cleaning nozzle system are provided. However, it goes without saying that it is feasible to provide an upper and a lower cleaning nozzle system which serve jointly for spraying cleaning liquid (during a cleaning phase) and for spraying final-rinse liquid (during a final-rinse phase). The cleaning nozzles 64 and 65 and/or the final-rinse nozzles 79 and 80 can also be arranged only at the top or only at the bottom, instead of at the bottom and at the top, or, instead or in addition to this, can also be arranged on one side of the treatment chamber 60 and be directed into the washware region transversely to the treatment chamber 60.

In the embodiment of the dishwasher 2.2 illustrated in FIG. 2, the water heater 71 is connected to a return-prevention means 81 via fresh-water feed lines 75, 76 and 72. The return-prevention means 81 prevents the possibility of fresh water being drawn back from the intake end of the final-rinse pump 69 into a fresh-water feed line 83 which can be connected to a fresh-water system, for example, via a valve 82.

As illustrated in FIG. 2, the return-prevention means 81 can have an outlet 84 which is connected to a water softener device 86 via fresh-water feed lines 75 and 85. The water softener device 86 can have, firstly, a salt container 87 which is connected to the fresh-water feed line 85 and, secondly, first and second water softeners 86*a*, 86*b* which are arranged parallel to one another. The two water softeners 86*a*, 86*b* which are arranged parallel to one another can be connected to the outlet 84 of the return-prevention means 81 via the abovementioned fresh-water feed line 24.

It is feasible for the water softeners 86*a*, 86*b* of the water softener device 86 to be operated alternately by suitable actuation of valves 88 in order to soften the fresh water which is supplied to the water heater 71 via the fresh-water feed lines 76 and 72.

The salt container 87 which forms part of the water softener device 86 contains a suitable salt or a suitable chemical with which a water softener agent, which is added in a metered fashion via the water softeners 86*a*, 86*b*, or a decomposition product, which is produced when a water softener agent is added in a metered fashion, can be suitably regenerated as required. The salt container 87 can be topped up with the salt or the chemicals from the treatment chamber 60 via an opening which can be closed by means of a lid 89.

The control device 50 which is used in the dishwasher 2.1 illustrated in FIG. 2 and is in the form of a batch dishwasher is designed to automatically set the treatment parameters of the cleaning phase and the treatment parameters of the final-rinse phase such that they are matched to one another, as a function of a selected execution program. To this end, it is feasible for the treatment parameters which are characteristic of the execution of different cleaning programs to be stored in the control device 50 or in the memory device 51 which forms part of the control device 50. The treatment parameters which form part of a cleaning program define at least the important factors when treating the washware during the cleaning phase and when treating the washware during the final-rinse phase.

Therefore, the control device 50 is designed, in particular, to correspondingly actuate the wash pump 62, the final-rinse pump 69, the heating means 77 of the water heater 71 and/or a heating device 90 which is provided in the tank 61 in accordance with the process parameters associated with a selected execution program.

It is important that the embodiments of the dishwasher 2.1, 2.2 according to the invention schematically illustrated in the drawings are designed not only for mechanically executing a cleaning program which can be executed by a conventional dishwasher but also for mechanically executing special execution programs which are stored in the control device 50 or in the memory device 51 which forms part of the control device 50 and have been created taking into account requirements for hygienic operation of a commercial dishwasher which apply in certain territorial regions. These individual execution programs, which have each been created taking into account requirements for hygienic operation which apply in different territorial regions, differ, in particular, in respect of the minimum temperature of the final-rinse liquid which is to be sprayed and/or in respect of the minimum temperature of the wash liquid which is to be sprayed. Differences in the washware contact time and/or in the minimum nozzle pressure (dishwashing mechanics) are likewise feasible.

In this way, the present invention allows the user of the dishwasher 2.1, 2.2 to select a corresponding execution program, which was previously stored in the control device 50, by means of a user interface 52 which forms part of the control device 50, in order to select that execution program for the dishwasher 2.1, 2.2 which exactly meets the applicable hygiene requirements, so that the washware is not excessively treated and resources (water, energy and chemicals) can be saved.

The user interface 52 preferably has a programming interface 53, so that the execution programs which are stored in the control device 50 can be updated and/or overwritten as required.

The control device 50 which is used in the solution according to the invention is preferably also designed to realize the following program sequence:

i) defining a requirement for the hygienic operation of a commercial dishwasher, in particular a relevant standard, hygiene guideline or the like, which is applicable in a territorial region;

ii) selecting an execution program for the dishwasher which has been created taking into account the defined requirement for the hygienic operation of a commercial dishwasher, with this selection preferably being made by manual input into the user interface 52; and iii) treating the washware in accordance with the selected execution program.

The invention is not restricted to the embodiments of FIGS. 1 and 2 which are shown by way of example in the drawings. Rather, the invention can be gathered from an overall expert view of the patent claims and of the description of the exemplary embodiments.

The invention claimed is:

1. A dishwasher having at least one wash system for spraying wash liquid in a wash zone or during a wash phase and at least one final-rinse system for spraying final-rinse liquid in a final-rinse zone or during a final-rinse phase, wherein a control device is also provided for actuating the at least one wash system and/or the at least one final-rinse system in accordance with a predefined execution program, wherein a first execution program is stored in the control device, the first execution program defining each of a first minimum wash liquid temperature, a first minimum final-rinse liquid temperature, a first minimum wash liquid contact time and a first minimum final-rinse liquid contact time as required to meet a first set of hygienic requirements applicable in a first territorial region;

a second execution program is stored in the control device, the second execution program defining each of a second minimum wash liquid temperature, a second minimum final-rinse liquid temperature, a second minimum wash liquid contact time and a second minimum final-rinse liquid contact time as required to meet a second set of hygienic requirements applicable in a second territorial region that is different than the first territorial region;

wherein the second minimum wash liquid temperature is different than the first minimum wash liquid temperature and the second minimum final-rinse liquid temperature is different than the first minimum final-rinse liquid temperature; and wherein the second minimum wash liquid contact time is different than the first minimum wash liquid contact time and the second minimum final-rinse liquid contact time is different than the first minimum final-rinse liquid contact time; and a user interface is also provided for manually selecting the first execution program or the second execution program stored in the control device.

2. Dishwasher according to claim 1, wherein the control device has a memory device in which the first execution program and the second execution program are stored, and wherein the user interface has a programming interface for overwriting and/or updating the first execution program and the second execution program.

3. Dishwasher according to claim 1, wherein the dishwasher is in the form of a conveyor dishwasher, and has a conveyor apparatus for conveying the washware which is to be cleaned through treatment zones of the dishwasher, wherein the wash system is implemented in at least one wash zone in which wash liquid is sprayed out of a wash tank which is associated with the at least one wash zone with the aid of a wash pump by means of wash nozzles, onto the washware which is to be cleaned, and wherein the final-rinse system is implemented in at least one final-rinse zone which is downstream of the wash zone as seen in the conveying direction and in which final-rinse liquid is sprayed out of a final-rinse reservoir, which is associated with the at least one final-rinse zone, with the aid of a final-rinse pump by means of final-rinse nozzles, onto the washware which is to be cleaned.

4. Dishwasher according to claim 3, wherein the wash tank, which is associated with the at least one wash zone, has a heating device which can be actuated by the control device in such a way that the temperature of the wash liquid in the wash tank assumes a temperature value that is no less than a minimum temperature value, which is defined in a selected execution program for the wash phase; and/or wherein the final-rinse reservoir which is associated with the at least one final-rinse zone has a final-rinse tank with a heating device which can be actuated by the control device in such a way that the temperature of the final-rinse liquid in the final-rinse reservoir assumes a temperature value that is no less than a minimum temperature value, which is defined in a selected execution program for the final-rinse phase.

5. Dishwasher according to claim 4, wherein the wash pump can be actuated by the control device in such a way that the nozzle pressure of the wash nozzles assumes a value which corresponds to an application pressure that is no less than a minimum application pressure, which is defined in a selected execution program for the wash phase.

6. Dishwasher according to claim 4, wherein the conveyor apparatus can be actuated by the control device in such a way that a residence time of washware, which is conveyed through the dishwasher with the aid of the conveyor apparatus, in the at least one wash zone and in the at least one final-rinse zone corresponds to a washware contact time, in particular a minimum contact time, which is defined in a selected execution program for the wash phase and final-rinse phase.

7. Dishwasher according to claim 4, wherein the final-rinse pump can be actuated by the control device in such a way that the quantity of final-rinse liquid which is sprayed in the final-rinse zone per unit time corresponds to a minimum value, which is defined in a selected execution program.

8. Dishwasher according to claim 1, wherein the dishwasher is in the form of a batch dishwasher and has a treatment chamber in which washware can be held, wherein the wash system has a wash pump by means of which wash liquid can be sprayed from a wash tank, which is arranged beneath the treatment chamber, by means of a wash line system and by means of wash nozzles, into the treatment chamber, and wherein the final-rinse system has a final-rinse pump by means of which final-rinse liquid can be sprayed from a final-rinse reservoir, by means of a final-rinse line system and by means of final-rinse nozzles, into the treatment chamber.

9. Dishwasher according to claim 8, wherein the wash tank which is arranged beneath the treatment chamber has a heating device which can be actuated by the control device in such a way that the temperature of the wash liquid in the wash tank assumes a temperature value that is no less than a minimum temperature value, which is defined in a selected execution program for the wash phase; and/or wherein the final-rinse reservoir has a final-rinse tank with a heating device which can be actuated by the control device in such a way that the temperature of the final-rinse liquid in the final-rinse tank assumes a temperature value that is no less than a minimum temperature value, which is defined in a selected execution program for the final-rinse phase.

10. Dishwasher according to claim 8, wherein the final-rinse pump can be actuated by the control device in such a way that a quantity of final-rinse liquid which is sprayed in the final-rinse zone per unit time corresponds to a value, in particular a minimum value, which is defined in a selected execution program.

11. A dishwasher comprising:

at least one wash system for spraying a wash liquid in a wash zone or during a wash phase;

at least one final-rinse system for spraying a final-rinse liquid in a final-rinse zone or during a final-rinse phase;

a control device for actuating the at least one wash system and the at least one final-rinse system during dish cleaning operations in accordance with an execution program selected by an operator;

a first execution program stored in the control device, the first execution program defining a first minimum wash liquid temperature, a first minimum final-rinse liquid temperature, a first minimum wash liquid contact time and a first minimum final-rinse liquid contact time required to meet a first set of hygienic requirements applicable in a first territorial region such that the dishwasher can clean wares in compliance with the first set of hygienic requirements when in the first territorial region;

a second execution program stored in the control device, the second execution program defining a second minimum wash liquid temperature, a second minimum final-rinse liquid temperature, a second minimum wash liquid contact time and a second minimum final-rinse liquid contact time required to meet a second set of hygienic requirements applicable in a second territorial region such that the dishwasher can also clean wares in compliance with the second set of hygienic requirements when in the second territorial region;

wherein the second minimum wash liquid temperature is different than the first minimum wash liquid temperature and/or the second minimum final-rinse liquid temperature is different than the first minimum final-rinse liquid temperature;

wherein the second minimum wash liquid contact time is different than the first minimum wash liquid contact time and/or the second minimum final-rinse liquid contact time is different than the first minimum final-rinse liquid contact time; and a user interface for manually selecting the first execution program or the second execution program for use by the control device when carrying out a dish cleaning operation.

* * * * *